US006089031A

United States Patent [19]

Stegner et al.

[11] Patent Number: 6,089,031

[45] Date of Patent: Jul. 18, 2000

[54] METHOD AND APPARATUS OF COMPRESSOR HEIGHT AND ALIGNMENT ADJUSTMENT

[75] Inventors: David A. Stegner, West Salem; Edward F. Keuper, La Crosse, both of Wis.

[73] Assignee: American Standard Inc., Piscataway, N.J.

[21] Appl. No.: 09/390,232

[22] Filed: Sep. 3, 1999

[51] Int. Cl.[7] ..... F25B 45/00

[52] U.S. Cl. ..... 62/77; 62/298; 248/638

[58] Field of Search ..... 62/77, 298; 248/638, 248/674

[56] References Cited

U.S. PATENT DOCUMENTS 4,888,962 12/1989 Harper et al. ..... 62/503
4,964,609 10/1990 Tomell ..... 248/638
5,054,740 10/1991 Wheeler ..... 248/675
5,386,962 2/1995 Adriance et al. ..... 248/624

*Primary Examiner*—Henry Bennett
*Assistant Examiner*—Chen-Wen Jiang
*Attorney, Agent, or Firm*—William J. Beres; William O'Driscoll; Peter D. Ferguson

[57] ABSTRACT

A method of mounting a compressor above a heat exchanger. The method comprises the steps of: attaching a transfer device to the exterior of the heat exchanger where the transfer device has a lower arc surface and an upper sloped surface; positioning the compressor relative to a reference point to form a gap between the compressor and the heat exchanger; and placing a positioning device in the gap. The positioning device includes a lower sloped surface in slideable contact with the upper sloped surface of the transfer device. The method also includes the steps of: adjusting the positioning device so that the top surface of the positioning device contacts the compressor; and securing the positioning device to the heat exchanger and to the compressor.

20 Claims, 5 Drawing Sheets

METHOD AND APPARATUS OF COMPRESSOR HEIGHT AND ALIGNMENT ADJUSTMENT

BACKGROUND OF THE INVENTION

The present invention is directed to a method and apparatus for manufacturing a refrigeration system including a compressor externally mounted on a heat exchanger shell. The present invention is described in terms of a chiller system but is intended to be generally applicable to all refrigeration and air conditioning systems.

Chillers are refrigeration systems which provide a flow of chilled water for cooling large building complexes, campuses or the like. The chiller comprises a compressor, a condenser, an expansion device and an evaporator, all serially linked in a closed circuit. These chiller components are also physically arranged to take advantage of gravity during the operation of the chiller system. Condensed refrigerant flows downhill from the condenser through the expansion device to the evaporator where the refrigerant vaporizes in absorbing heat. The vaporized refrigerant is drawn up by compressor suction through a suction pipe and elbow section into the compressor where that refrigerant is pressurized. The pressure moves the pressurized refrigerant from the compressor through a discharge pipe and elbow section to the condenser where the refrigerant is condensed into a liquid and the cycle commences anew.

The layout of a typical chiller system is such that the compressor is located above the evaporator, and the condenser is laterally displaced between the compressor and evaporator. This is similar to a tri-level house where the condenser is located at the level of the main floor with the compressor half a flight up and mounted above the evaporator, and the evaporator located half a flight down from the condenser.

The compressor is a large heavy object and must be stable to support its high speed operation. A direct drive compressor has a normal speed of operation of about 3600 RPM, and a gear drive compressor has a normal speed of operation ranging between 10,000 and 12,000 RPM. In either case, the compressor must be firmly mounted to the evaporator shell so that the high speed rotation of the compressor and its motor, and the weight of that compressor and motor have stable operation. There are various ways and devices to assemble such a compressor to meet these requirements.

In assembling a chiller system, the previous chiller systems position the compressor motor above the evaporator shell, attach the compressor motor to the shell using a mounting plate, and then custom fit the discharge and suction pipe and elbow sections to the resultant compressor location. The fitting of the discharge and suction pipe and elbow sections is a time consuming, laborious process which is occurring on the final assembly line and thus delaying production. Furthermore, standardized discharge and suction pipe and elbow sections cannot be used because the heat exchanger shell upon which the compressor is mounted is inherently unique due to variations resulting from the manufacturing process. The shells are formed of rolled steel and have minor individual variations from the rolling process. More critically, the shells are welded into a cylinder using a lateral weld along the entire length of the shell. The lateral weld causes distortion, distorting each shell uniquely and unpredictably.

Traditionally, the compressor is mounted to the shell and the adjustments are made in the discharge and suction pipe and elbow sections of the compressor. To improve the manufacturing process, it is desirous to standardize the suction and diffuser pipe and elbow sections. It is also desirous to manufacture the suction and discharge pipe and elbow sections at a side location rather than on the final assembly line.

SUMMARY OF THE INVENTION

It is an object, feature and advantage of the present invention to solve problems in the manufacture of previous chiller systems.

It is an object, feature and advantage of the present invention to provide a chiller system with a compressor mounted to a heat exchanger where the suction and discharge pipe and elbow sections of the compressor are standardized.

It is a further object, feature and advantage of the present invention that the manufacture of the suction and discharge pipe and elbow sections occur somewhere other than on the main assembly line.

It is a further object, feature and advantage of the present invention to precisely position a compressor relative to a heat exchanger shell without regard to variations in the surface of the heat exchanger shell itself.

It is a further object, feature and advantage of the present invention that all welds on the compressor support structure be from above and that the dripping of overhead welds be avoided.

It is an object, feature and advantage of the present invention to eliminate adjustments in the assembly of suction and discharge pipe and elbow sections during the manufacture of chiller systems.

It is a further object, feature and advantage of the present invention to allow manufacturing dimensional variation of shells while aligning a compressor mounted on that shell with some reference point.

The present invention provides a method of mounting a compressor above a heat exchanger. The method comprises the steps of: attaching a transfer device to the exterior of the heat exchanger where the transfer device has a lower arced surface and an upper sloped surface; positioning the compressor relative to a reference point to form a gap between the compressor and the heat exchanger; and placing a positioning device in the gap. The positioning device includes a lower sloped surface in slideable contact with the upper sloped surface of the transfer device. The method also includes the steps of: adjusting the positioning device so that the top surface of the positioning device contacts the compressor; and securing the positioning device to the heat exchanger and to the compressor.

The present invention additionally provides a method of mounting a compressor above a heat exchanger. The method includes the steps of: attaching a pair of vertically oriented plates to the exterior of the heat exchanger where the vertical plates are laterally spaced; providing a sloped surface on a top or upwardly facing portion of each plate; positioning the compressor relative to a reference point to form a gap between the compressor and the heat exchanger; placing a positioning device in the gap, the positioning device including a sloped surface in slideable contact with the sloped surface of each plate; adjusting the positioning device so that a top surface of the positioning device contacts the compressor; and fastening the positioning device to the heat exchanger and to the compressor.

The present invention also provides a method of mounting a compressor upon a heat exchanger. The method includes the steps of: providing pairs of vertical plates having at least a portion of the top surface at an incline; welding the pairs of vertical plates to a heat exchanger; positioning a compressor relative to a reference point associated with the heat exchanger; locating a positioning device in proximity to the inclined top surface such that the positioning device spans a gap between the pairs of vertical plates and the compressor; and fastening the positioning device to the compressor and the pairs of vertical plates.

The present invention further provides a vertical plate for use in mounting a compressor upon a heat exchanger. The plate includes a plate portion adapted for vertical alignment; a lower surface to the plate portion having a contour adapted to engage an outer surface of the heat exchanger; and an inclined segment of the vertical portion where the incline is at a predetermined angle.

DETAILED DESCRIPTION OF THE DRAWINGS

Figure 1:
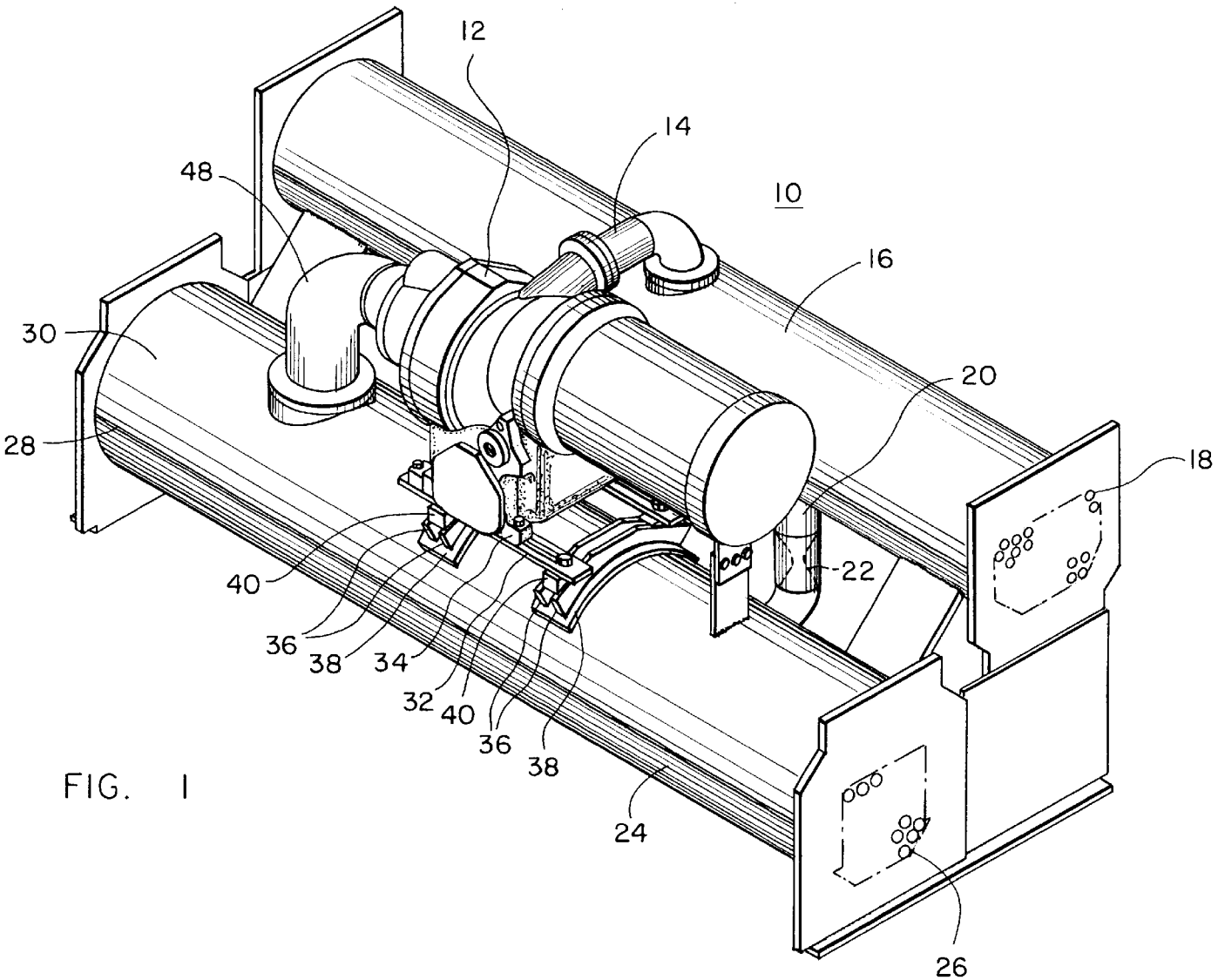
FIG. 1 is a perspective view of a chiller system in accordance with the present invention.

An air conditioning system that incorporates the standard components of a chiller system as shown generally at 10 in FIG. 1. The system 10 includes a compressor 12 which compresses refrigerant vapor. The compressor 12 is typically an electric motor driven unit powered by an induction motor. The compressor 12 compresses and moves pressurized refrigerant vapor through a discharge fitting 14 to a condenser 16. The condenser 16 is a heat exchanger that extracts heat from the refrigerant vapor and, at the same time condenses the refrigerant gas to a liquid. The heat extracted from the refrigerant is either exhausted to the atmosphere directly by means of an air cooled condenser or indirectly by heat exchange with another water loop 18 and a cooling tower or the like. The pressurized liquid refrigerant passes from the condenser 16 to a fitting 20 including an expansion device 22 such as an orifice plate. The expansion device 22 serves to reduce the pressure of the refrigerant liquid. The refrigerant then flows into an evaporator 24 where the refrigerant performs a cooling function in heat exchange with a water loop 26. In the evaporator 24, the refrigerant changes state a second time and evaporates into a vapor. This change of state and any superheating of the refrigerant vapor causing a cooling effect on the fluid in the loop 26. This chilled fluid is pumped to a building, complex, campus or the like for use in conditioning air.

The evaporator 24 is cylindrically formed of rolled steel, and the cylinder 30 is completed by a lateral weld 28 running the longitudinal length of the cylinder 30.

The compressor 12 is vertically mounted above a heat exchanger, preferably the evaporator 24 but alternatively a condenser 16 in a different system arrangement, by compressor mounting bars 32 are in turn bolted to compressor legs 34. The compressor mounting bars are welded to positioning devices, such as wedges 40, which in turn are welded to a transfer device, such as vertical mounting plates 36. The vertical mounting plates 36 are either welded directly to the shell 30 or welded to a saddle 38 which in turn is welded to the shell 30. Prior to welding, the wedges 40 between the vertical plates 36 and the compressor mounting bar 34 are used to align and position the compressor 12. Preferably, the vertical plates 36 are arranged in pairs and a positioning device such as the wedge 40 is located at each end 43 of a vertical plate 36.

Figure 2:
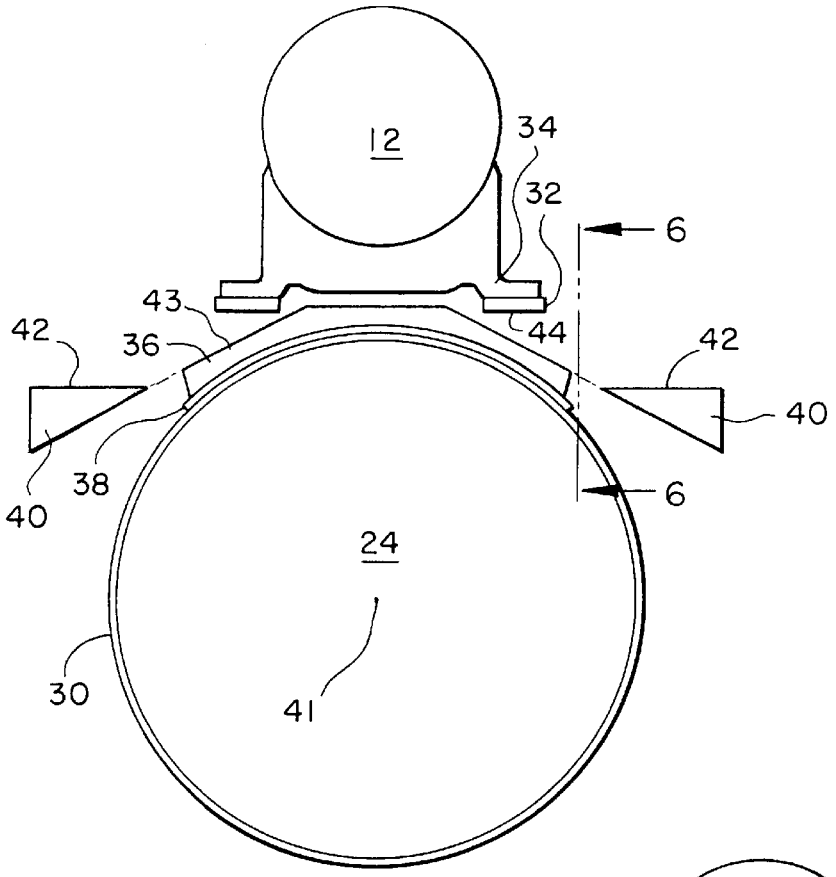
FIG. 2 shows a compressor suspended above a heat exchanger shell during assembly in accordance with the present invention.
Figure 3:
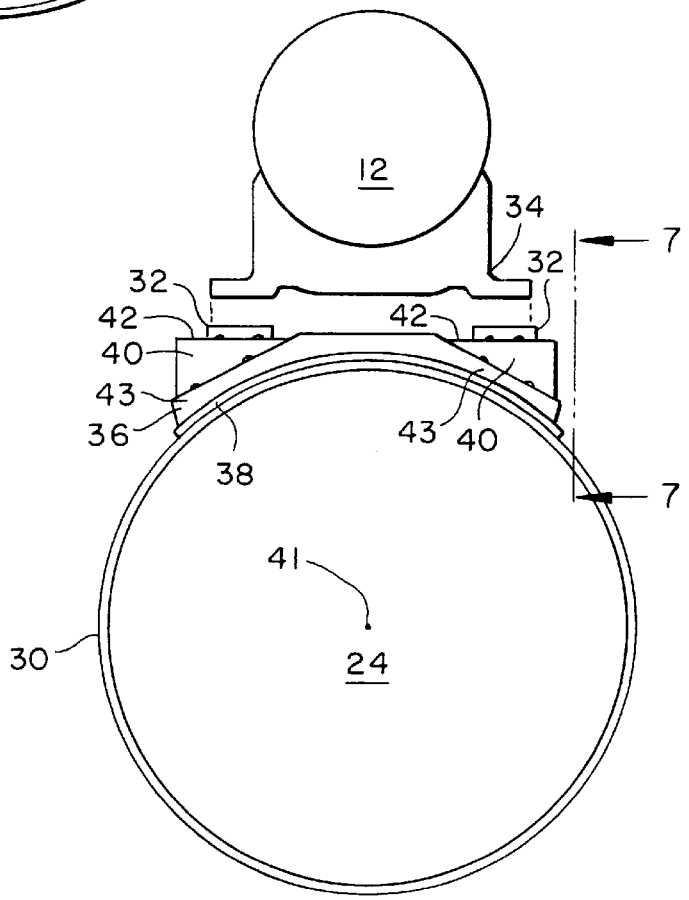
FIG. 3 shows an intermediate step in the manufacture of a chiller system in accordance with the present invention.

As shown in FIG. 2, the compressor 12 is suspended by a hoist or the like above the evaporator 24. The compressor 12 is precisely located with regard to a specific reference point such as an axis 41 of the cylinder 30. The individual wedges 40 are then loosely positioned on the vertical mounting plate 36 and located so that a top surface 42 of the wedge 40 engages a bottom surface 44 of the compressor mounting bar 32 and located so that a sloped face 54 of the wedge 40 engages a sloped face 52 of the pairs of vertical plates 36. The wedge 40 is then tack welded to each of the vertical plates 36, and the compressor mounting bar 32 is tack welded to the wedge 40. The compressor 12 is next disengaged from the compressor mounting bar 32 and hoisted away as shown in FIG. 3. This allows a welder overhead access to securely weld the compressor mounting bar 32 to the wedge 40, and to securely weld the wedge 40 to the vertical plates 36 using only welds from above. Very good clean welds usually occur with top welds since there is no vertical, gravitational dripping of the weld. After this welding, the compressor 12 is reattached to the compressor mounting bar 32 and the suction fitting 48 and discharge fitting 14 are attached. Since the compressor 12 is precisely located and positioned relative to the heat exchanger 24, premanufactured suction and discharge pipe and elbow sections 14, 48 can be used, and the overall manufacturing process is both expedited and simplified.

Figure 4:
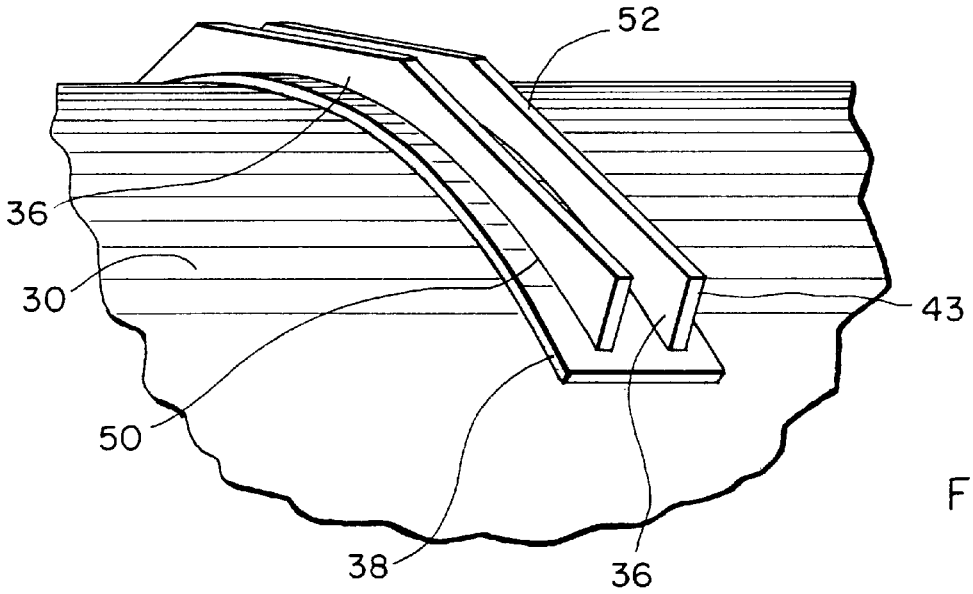
FIG. 4 is a perspective view of a pair of vertical plates mounted on a heat exchanger shell in accordance with the present invention.

Referring to FIG. 4, it can be seen that the vertical plates 36 include an arced portion 50 having an arc substantially similar to that of the arc of the shell 30. Prior to the previously described assembly, pairs of vertical plates 36 are welded to the shell 30 either directly or through an intermediate saddle 38. As denoted by their name, the vertical plates 36 have a vertical orientation. The vertical plates 36 also each include a sloped face 52 of identical predetermined slope.

Figure 5:
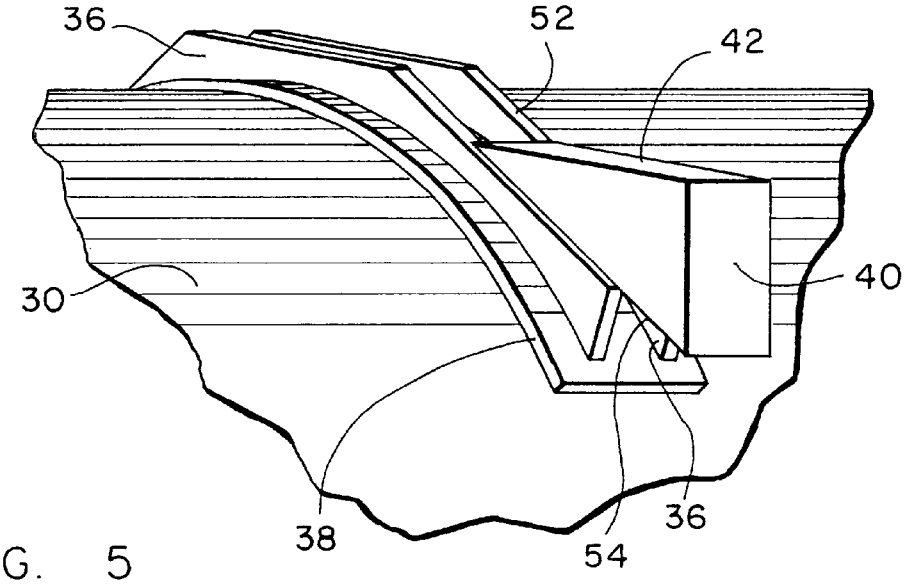
FIG. 5 shows a portion of FIG. 4 and further includes a wedge in accordance with the present invention.
Figure 6:
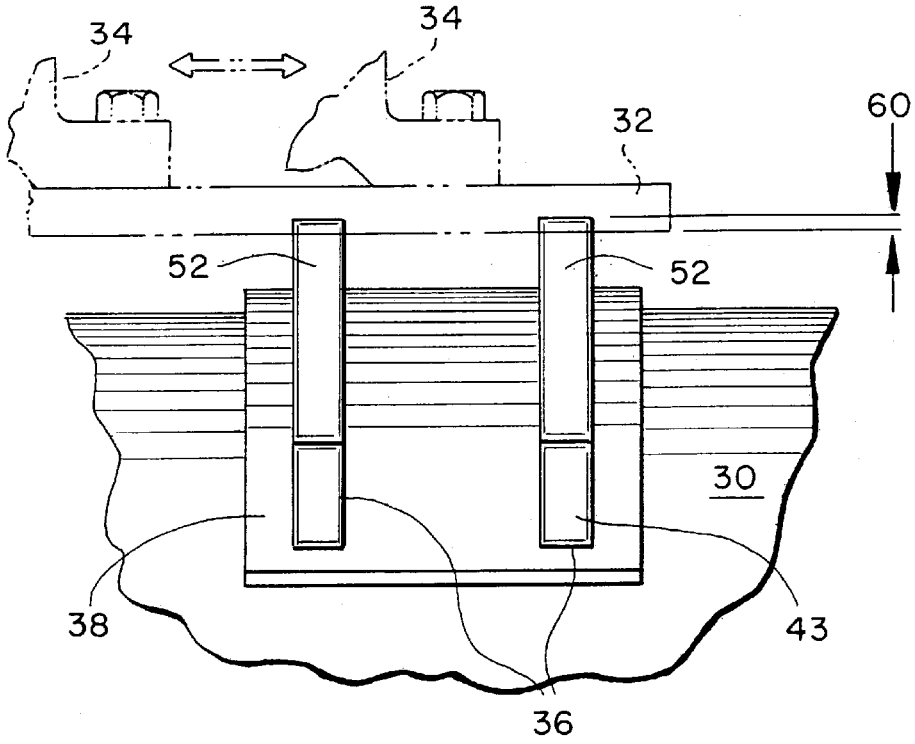
FIG. 6 is a side view of FIG. 2 taken along lines 6—6 with the wedge omitted.
Figure 7:
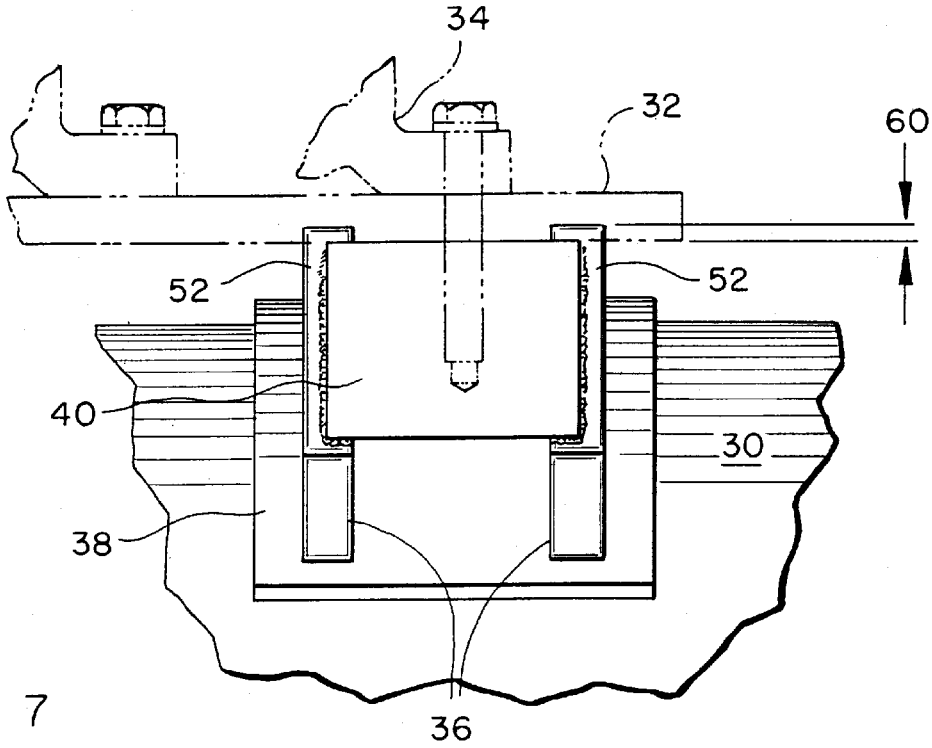
FIG. 7 is a side view of FIG. 3 taken along lines 7—7.

Referring to FIG. 5, the wedges 40 also include a sloped surface 54 where the slopes 52 and 54 are selected so that the top surface 42 of the wedge 40 is substantially horizontal when the slopes 52 and 54 are in engagement. Prior to fixing the wedge 40 in place relative to the vertical plate 36, the wedge 40 can be moved laterally along the sloped surface 52 so that the horizontal top surface 42 of the wedge 40 can be vertically adjusted and also aligned relative to the compressor mounting bar 32.

Effectively, the compressor 12 and the evaporator 24 are each independently positioned and any gap 60 is filled by adjusting the position of the wedge 40 relative to the vertical plate 36.

Figure 8:
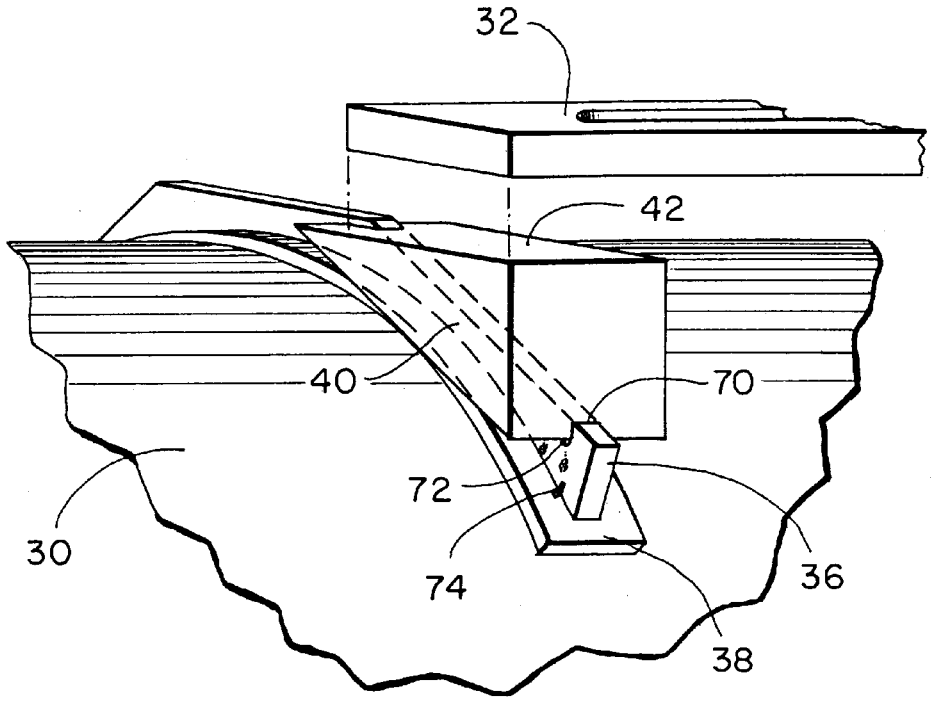
FIG. 8 is a first alternative embodiment of the present invention shown in perspective.

FIG. 8 shows a first alternative embodiment using a single vertical plate 36 as the transfer device instead of the pairs of vertical plates 36 used in FIGS. 1–7. In this alternative embodiment, like reference numerals are used to indicate like elements of the primary embodiment. In this embodiment, a channel 70 is formed in the wedge 40, the channel 70 having a slope similar to that of the surface 54. The shape of the wedge can vary since the channel 70 mates with the surface 52 to raise and lower the top surface 42 by sliding the wedge 40 inwardly and outwardly along the surface 52. The disadvantage of this embodiment is that the weld attaching the wedge 40 to the vertical plate 36 is an upward weld and the weld 72 will not be as good since gravity will pull drips 74 downwardly.

Figure 9:
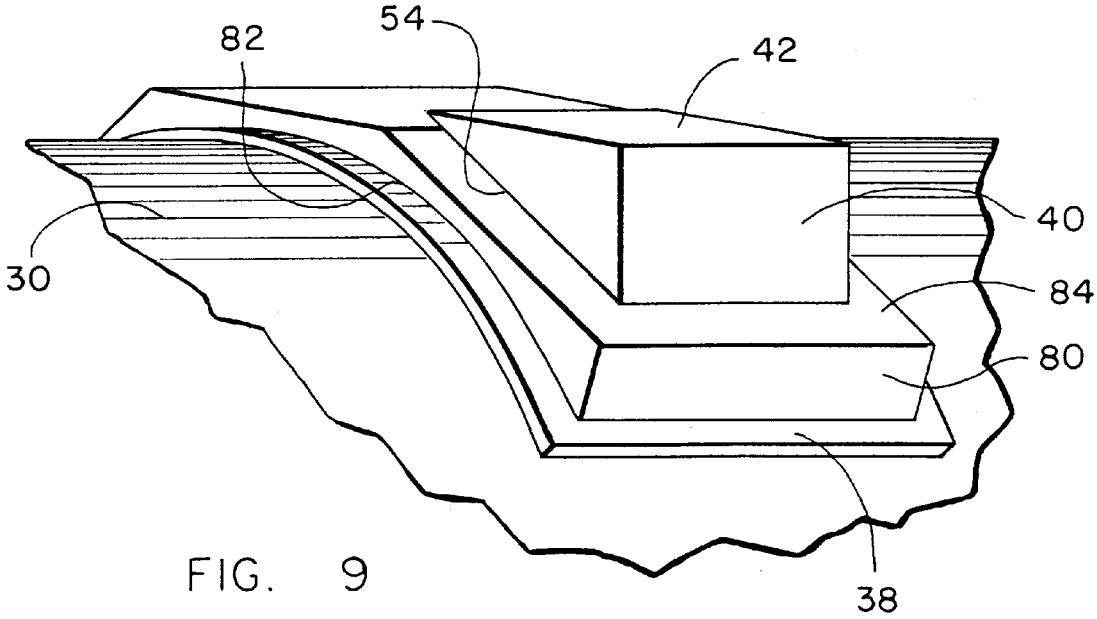
FIG. 9 is a second alternative embodiment of the present invention shown in perspective.

FIG. 9 shows a second alternative embodiment using a single wide block 80 as the transfer device instead of the pairs of vertical plates 36 used in FIGS. 1–7. In this alternative embodiment, like reference numerals are used to indicate like elements of the primary embodiment. In this second alternative embodiment, the wide block 80 has a lower surface 82 with an arc generally matching the surface of either the saddle 38 or the shell 30. The wide block 80 also includes a sloped upper surface 84 having a slope selected in combination with the slope of a lower surface 54 of the wedge 40 such that the upper surface 42 of the wedge 40 is substantially horizontal.

What has been described is a method of mounting a compressor above a heat exchanger whereby the heat exchanger and the compressor are independently aligned and use pre-made standardized suction and discharge fixtures. A transfer device having an arced lower surface and a sloped upper surface is used to change the arc of the heat exchanger shell to a slope. A positioning device having a mating sloped lower surface selected so that the upper surface of the positioning device is substantially horizontal is used to slide along the sloped upper surface of the transfer device and thereby vertically position the positioning device. The form of both the transfer device and the positioning device can vary. For example, the horizontal dimension of the block 80 may be wider than the corresponding horizontal dimension of the wedge 40 to allow both sides of the wedge 40 to be welded to the block 80. It will be apparent to a person of ordinary skill in the art that many modifications and alterations in the use of the wedge to align and adjust the compressor relative to the heat exchanger are possible. Examples include the use of a scroll shaped wedge sliding on a curved surface 52 rather than a planar surface 52, or the use of a keyhole or flange on the wedge to slideably secure it with a mating vertical plate or plates. The vertical plates may also be varied in that a single wide wedge shape plate could be positioned on the heat exchanger shell where the wide shape had an appropriate surface 52 for the wedge 40 to ride upon. Other variations include changing the shape of the wedge and/or the slope that the surfaces 52, 54 slideably engage upon including, for example, sloping the surfaces in several dimensions. All such modifications, alterations and variations are contemplated to fall within the claims of this invention.

What is claimed is as follows:

1. A method of mounting a compressor above a heat exchanger comprising the steps of:

attaching a transfer device to the exterior of the heat exchanger where the transfer device has a lower arced surface and an upper sloped surface;

positioning the compressor relative to a reference point to form a gap between the compressor and the heat exchanger;

placing a positioning device in the gap, the positioning device including a lower sloped surface in slideable contact with the upper sloped surface of the transfer device;

adjusting the positioning device so that the top surface of the positioning device contacts the compressor; and securing the positioning device to the heat exchanger and to the compressor.

2. The method of claim 1 including the further step of forming the positioning device into a wedge shape.

3. The method of claim 2 wherein the transfer device comprises a pair of vertically oriented plates.

4. The method of claim 3 including the further step of selecting the sloped surface of the vertical plates and the sloped bottom surface of the wedge to define a horizontal top surface for the wedge.

5. The method of claim 4 including the further step of attaching a pre-made pipe and elbow section connecting the compressor to the heat exchanger.

6. The method of claim 5, wherein the securing step includes welding the positioning device from an overhead direction.

7. The method of claim 2 wherein the transfer device comprises a single vertically oriented plate, and the wedge includes a channel in its lower surface.

8. The method of claim 2 wherein the transfer device is a single block having a horizontal dimension wider than the corresponding horizontal dimension of the wedge.

9. A method of mounting a compressor above a heat exchanger comprising the steps of:

attaching a pair of vertically oriented plates to the exterior of the heat exchanger where the vertical plates are laterally spaced;

providing a sloped surface on a top or upwardly facing portion of each plate;

positioning the compressor relative to a reference point to form a gap between the compressor and the heat exchanger;

placing a positioning device in the gap, the positioning device including a sloped surface in slideable contact with the sloped surface of each plate;

adjusting the positioning device so that a top surface of the positioning device contacts the compressor; and fastening the positioning device to the heat exchanger and to the compressor.

10. The method of claim 9 including the further step of attaching a premade fixture connecting the compressor to the heat exchanger.

11. The method of claim 9 wherein the step of fastening includes welding the positioning device from an overhead direction.

12. The method of claim 9 including the further step of forming the positioning device in the shape of a wedge having an inclined bottom surface and a substantially horizontal upper surface.

13. The method of claim 12 including the further step of selecting the sloped surface of the vertical plate and the inclined bottom surface of the wedge to define a horizontal top surface for the wedge.

14. A method of mounting a compressor upon a heat exchanger comprising the steps of:

providing pairs of vertical plates having at least a portion of the top surface at an incline;

welding the pairs of vertical plates to a heat exchanger;

positioning a compressor relative to a reference point associated with the heat exchanger;

locating a positioning device in proximity to the inclined top surface such that the positioning device spans a gap between the pairs of vertical plates and the compressor; and fastening the positioning device to the compressor and the pairs of vertical plates.

15. The method of claim 14 wherein the step of fastening includes welding the positioning device from an overhead direction.

16. The method of claim 15 including the further step of forming the positioning device in the shape of a wedge having an inclined bottom surface and a substantially horizontal upper surface.

17. The method of claim 16 including the further step of selecting the incline top surface of the vertical plate and the inclined bottom surface of the wedge to define the horizontal top surface of the wedge.

18. A transfer device for use in mounting a compressor upon a heat exchanger comprising:

a body;

an arced lower surface of the body adapted for engagement to an outer surface of a heat exchanger; and a substantially planar sloped upper surface of the body.

19. The transfer device of claim 18 wherein the body includes a plate portion adapted for vertical alignment.

20. The plate of claim 19 further including an intermediate attachment piece between the lower surface and the heat exchanger shell.

* * * * *